US007536871B1

(12) United States Patent
Sciortino

(10) Patent No.: US 7,536,871 B1
(45) Date of Patent: May 26, 2009

(54) ICEMAKER WITH IMPROVED CAM ASSEMBLY

(76) Inventor: Ronald R. Sciortino, 101 River Rd., Jefferson, LA (US) 70121

( * ) Notice: Subject to any disclaimer, the term of this patent is extended or adjusted under 35 U.S.C. 154(b) by 0 days.

(21) Appl. No.: 11/047,425

(22) Filed: Jan. 31, 2005

Related U.S. Application Data

(60) Provisional application No. 60/542,549, filed on Feb. 6, 2004, provisional application No. 60/540,172, filed on Jan. 29, 2004.

(51) Int. Cl.
*F25C 5/02* (2006.01)

(52) U.S. Cl. ..... 62/320; 241/DIG. 17

(58) Field of Classification Search ..... 62/320; 241/285.1, 285.2, DIG. 17; 74/169, 577 S; 192/43.1, 46
See application file for complete search history.

(56) References Cited

U.S. PATENT DOCUMENTS

| | | | | | |
|---|---|---|---|---|---|
| 2,515,923 | A | * | 7/1950 | Hansen | 241/92 |
| 4,188,774 | A | * | 2/1980 | Besson | 368/38 |
| 4,575,012 | A | * | 3/1986 | Uphoff et al. | 241/92 |
| 4,655,403 | A | * | 4/1987 | Sciortino | 241/92 |
| 4,679,453 | A | * | 7/1987 | Morita et al. | 74/128 |
| 5,269,195 | A | * | 12/1993 | Kitagawara | 74/411.5 |
| 5,706,536 | A | * | 1/1998 | Krauska | 5/618 |

* cited by examiner

*Primary Examiner*—William E. Tapolcai

(57) ABSTRACT

A cam assembly for an icemaker with a pusher ratchet arm that includes a cam connector and a cam member. The cam member is a unitary elongated structure with a back forked end pivotally coupled to the cam connector. The front of the cam member is designed with a indented cavity on the bottom surface to receive a ratchet tooth so that the cam member completes a full arc-of-rotation. The cam connector has a quasi-tear drop shape to dramatically round corners of the connector. The quasi-tear drop shape and cam assembly enhances the distance traveled by the pusher ratchet arm during a full arc-of-rotation of the cam assembly.

20 Claims, 3 Drawing Sheets

ICEMAKER WITH IMPROVED CAM ASSEMBLY

CROSS-REFERENCE TO RELATED APPLICATIONS

Priority of U.S. Provisional Patent Application Ser. No. 60/542,549, filed Feb. 6, 2004, incorporated herein by reference, is hereby claimed.

Priority of U.S. Provisional Patent Application Ser. No. 60/540,172, filed Jan. 29, 2004, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to icemakers and, more particularly, to an icemaker with an improved cam assembly that maximizes the distance a pusher plate can be advanced by a single stroke.

2. General Background of the Invention

My original icemaker is described in U.S. Pat. No. 4,655,403, entitled "ICE SHAVING MACHINE WITH STABILIZATION MEANS," is incorporated herein by reference as if set forth in full below. Referring now to prior art FIG. 1, the pusher arm 94 is provided with ratchets 96 along an upward edge thereof. Ratchets 96 mate with a horizontal pin 99*a* carried by elongated members 98, the pin 99*a* is advanceable towards the cutter by application of torque to handle 100. As the pin 99*a* advances, the elongated members 98 pivot about pin 99*c* connected to connector 105.

Once the pusher arm 94 has been advanced, in the direction of ARROW A, as far as possible by engagement with one of the ratchet teeth 93, pressure is released on the handle 100 and the pin 99*a* is engaged with a ratchet tooth closer to the end of pusher arm 94 (such end of the pusher arm 94 being in a direction opposite that of ARROW A.) Torque to handle 100 can then be applied to once again advance the pusher arm 94 and thus the pusher plate 88 (not shown—see FIG. 2 of U.S. Pat. No. 4,544,403, incorporated herein by reference).

One of the problems with the existing configuration of members 98, held in space relation by pins 99*a*, 99*b* and 99*c*, is that the manufacturing of this configuration is labor intensive with little in-use life. The members 98 must be cut, drilled, reamed, deburred, polished and corners rounded. Additionally, the pins 99*a*, 99*b* and 99*c* are affixed and aligned so that the members 98 are substantially parallel.

In the prior art, the pins 99*a*, 99*b* and 99*c* are stainless steel and the members 98 are aluminum. Additionally, the space between pins 99*a* and 99*b* was sufficient to allow for an adjacent ratchet tooth clearance. The pin 99*a*, since it is in metal-to-metal contact with ratchet 96, wears down quickly as the pin rotates within the a ratchet channel 93*a* and thus, requires replacement. As can be appreciated, when the members 98 are replaced, the icemaker is offline and profits lost. Hence, increasing the time between replacements is highly desirable.

The connector 105 connects the members 98 via pin 99*c* to the handle 100. The connector 105 is comprised of a generally L-shaped solid structure having a first hole for receiving therethrough pin 98*c* and a second hole for receiving the handle 100 therethrough. This L-shaped profile limits the distance the pusher arm 94 could travel.

Referring now to FIG. 1 of U.S. Pat. No. 4,544,403, an inner plate 36 is configured to close a first open end of the inner box of the icemaker. The inner plate 36 is composed of a flat member having an area only slightly less than the cross-sectional area of the open end. Perpendicular flanges 38 are provided on each edge of the flat member, flanges 38 fitting flat against the interior walls of the inner box. Inner plate 36 defines an elongated slot 40 which is oriented vertically in plate 36. Pusher arm 94 is journalled through the elongated slot 40 to pusher plate 88.

In view of the foregoing, there is a continuing need for a cam assembly that is less labor intensive to manufacture.

Furthermore, there is a continuing need for a cam assembly that has an improved wear factor such that the surface area and thickness of the cam member which is in direct metal-to-metal contact while pushing and rotating in the ratchet channel is increased. Thus, the time between replacements of the cam member is reduced. In other words, the useful life of the cam member is increased.

There is a still further continuing need for a cam assembly that has a cam member that has an improved tooth-to-ratchet channel fit to increase the length of the arc-of-rotation of the cam member in the ratchet channel.

A still further continuing need is for a cam assembly that increases the distance a pusher arm travels during a full arc-of-rotation of the cam member in the ratchet channel. Thus, the volume of ice shavings created for a full arc-of-rotation is increased.

A still further continuing need is for an improved icemaker with a cam assembly that requires less replacements of the cam member and pushes the pusher arm applying pressure to the pusher plate greater distances in a full arc-of-rotation of the cam member.

As will be seen more fully below, the present invention is substantially different in structure, methodology and approach from that of prior icemakers.

The following U.S. patents are incorporated herein by reference: U.S. Pat. Nos. 2,515,923; 4,655,403.

BRIEF SUMMARY OF THE INVENTION

The preferred embodiment of cam assembly of the present invention solves the aforementioned problems in a straight forward and simple manner.

Broadly, what is provided is a cam assembly for an icemaker having a pusher arm with ratchet teeth comprising: a cam connector, the cam connector is adapted to be coupled to a handle of said icemaker; and, a cam member having a single elongated structure that has a gradually tapering width from back to front, the back having a forked end pivotally coupled to said cam connector and the front having a second end, the second end has formed in a bottom surface thereof, a indented cavity for receipt of a ratchet tooth.

The present invention contemplates an icemaker that employs the improved cam assembly.

In view of the above, an object of the present invention is to provide a cam assembly that has an improved wear factor such that the surface area and thickness of the cam member which is in direct metal-to-metal contact while pushing and rotating in the ratchet channel is increased. Thus, the time between replacements of the cam member is reduced and the useful life increased over the prior art.

A further object of the present invention is to provide a cam assembly having a cam member that has an improved tooth-to-ratchet channel fit to increase the length of the arc-of-rotation of the cam member in the ratchet channel.

A still further object of the present invention is to provide a cam assembly that increases the distance a pusher arm travels during a full arc-of-rotation of the cam member in the ratchet channel. Thus, the volume of ice shavings created for a full arc-of-rotation is increased.

A still further object of the present invention is to provide a cam assembly that requires less replacements of the cam member and pushes the pusher arm applying pressure to the pusher plate greater distances in a full arc-of-rotation of the cam member.

In view of the above, a feature of the present invention is to provide a cam assembly that is less labor intensive to manufacture by forming a single unitary structure.

Another feature of the present invention is to provide an icemaker that provides a larger volume of ice shaving for a full arc-of-rotation over the prior art.

A further feature of the present invention is to provide a cam assembly that is relatively low in cost to manufacture.

A still further feature of the present invention is to provide a cam assembly that is easy to re-install during replacement.

The above and other objects and features of the present invention will become apparent from the drawings, the description given herein, and the appended claims.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
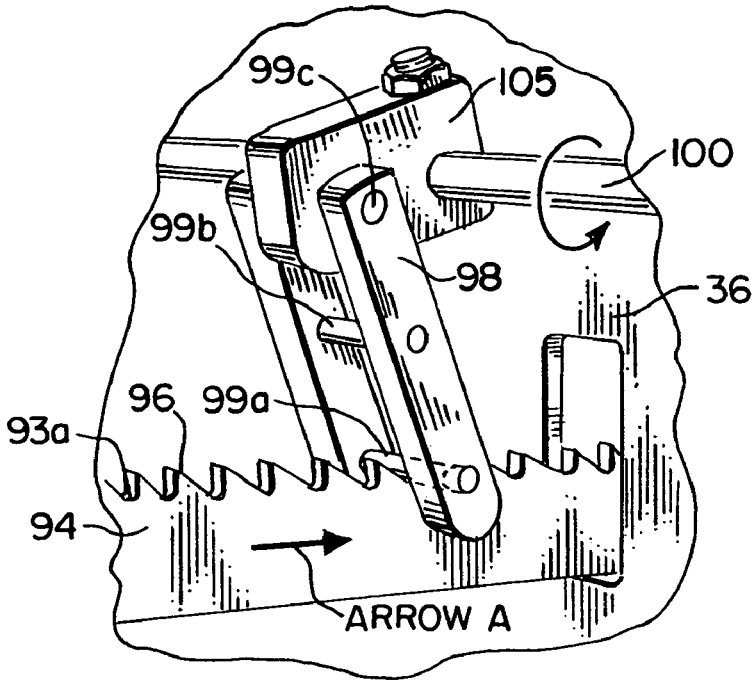
FIG. 1. PRIOR ART
FIG. 1 is a partial end view of an icemaker in accordance with the prior art depicting the pusher arm, ratchet and related members.

Referring now to FIGS. 2–4 and 6–7, the cam assembly of the present invention is generally referenced by the numeral 210. The cam assembly 210 includes a cam member 220 and a cam connector 250, the cam connector 250 is adapted to be coupled to handle 320 of icemaker 300, as best seen in FIG. 5.

Cam member 220 includes a single elongated structure 222 that has a gradually tapering width W from back B to front F. Furthermore, the single elongated structure 222 has a forked first end 224 and a second end 226. The forked end 224 creates first and second essentially parallel fork members 225*a* and 225*b* each of which has through holes 234*a* and 234*b*, respectively, formed therein. The through holes 234*a* and 234*b* receive therein pin member 236.

The top surface 228*a* of the elongated structure 222 is generally flat. The side surfaces 228*b* and 228*c* of the elongated structure are essentially flat and are perpendicular to the top surface 228*a* and the bottom surface 228*d*. The front distal end 227 of the second end 226 is rounded.

The rounded contour of the front distal end 227 is dimensioned to be received and rotated in each and every ratchet channel 274 formed by any two adjacent ratchet teeth with one tooth being the rear ratchet tooth 272*b* and the other being the front ratchet tooth 272*a*. The front ratchet tooth 272*a* is the tooth the cam member 220 is currently applying pressure to as it rotates in a respective one ratchet channel 274 to push the pusher arm 270 in the direction of ARROW B.

Figure 4:
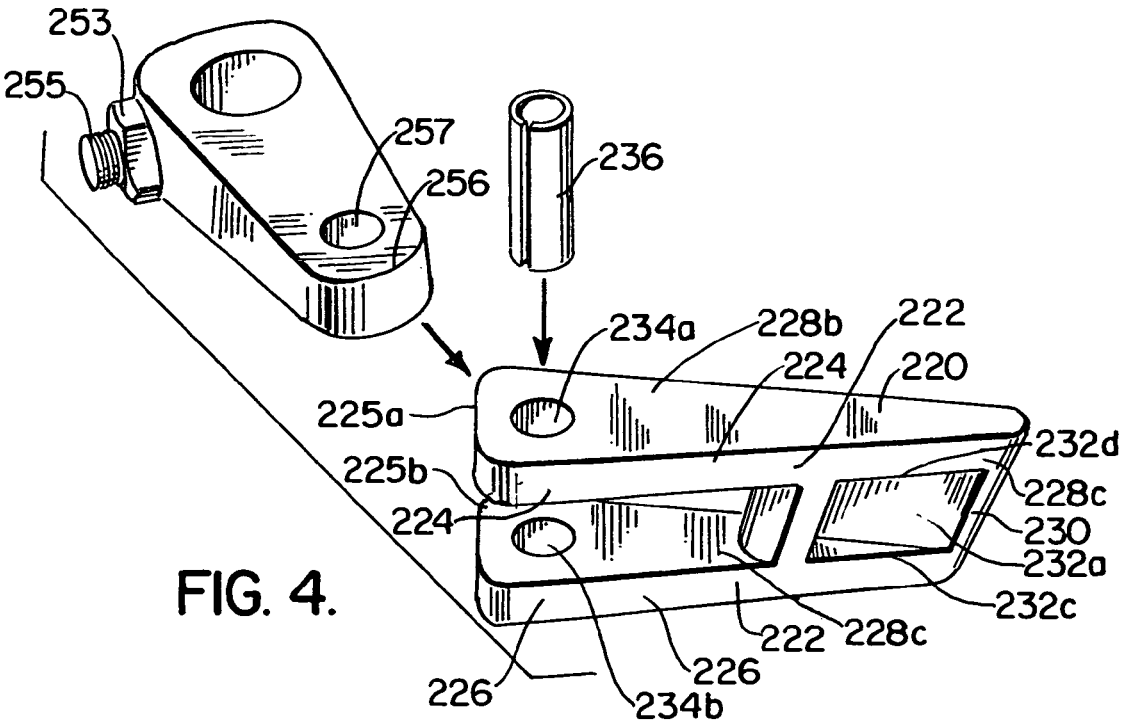
FIG. 4 is an exploded view of the cam member in of the embodiment of FIG. 2 with emphasis on the bottom side of the cam member.
Figure 5:
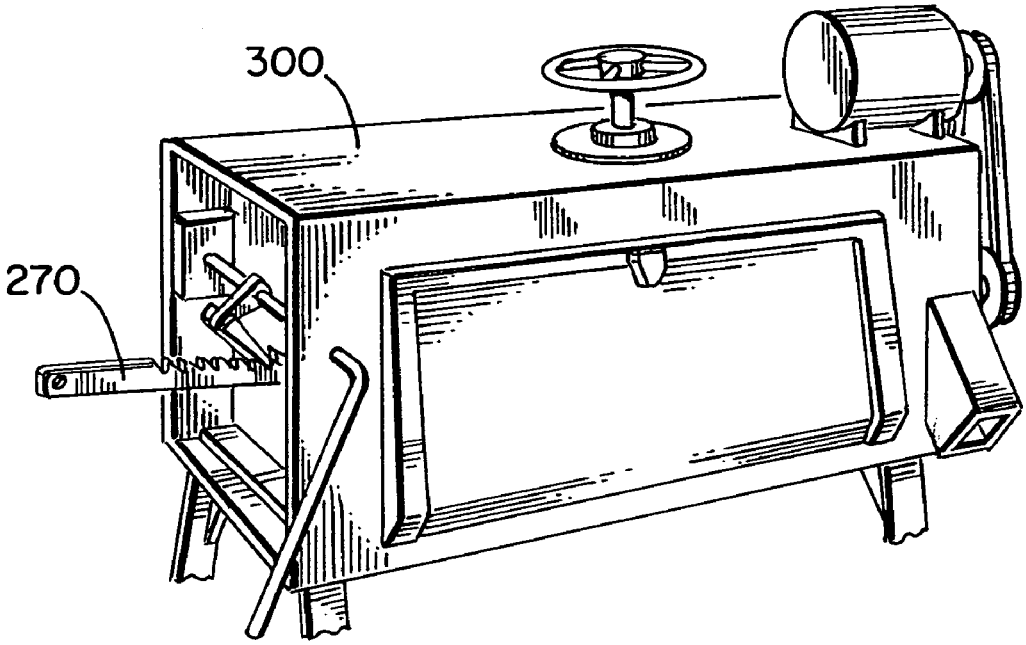
FIG. 5 illustrates the icemaker employing the cam member of the embodiment of FIG. 2.
Figure 7:
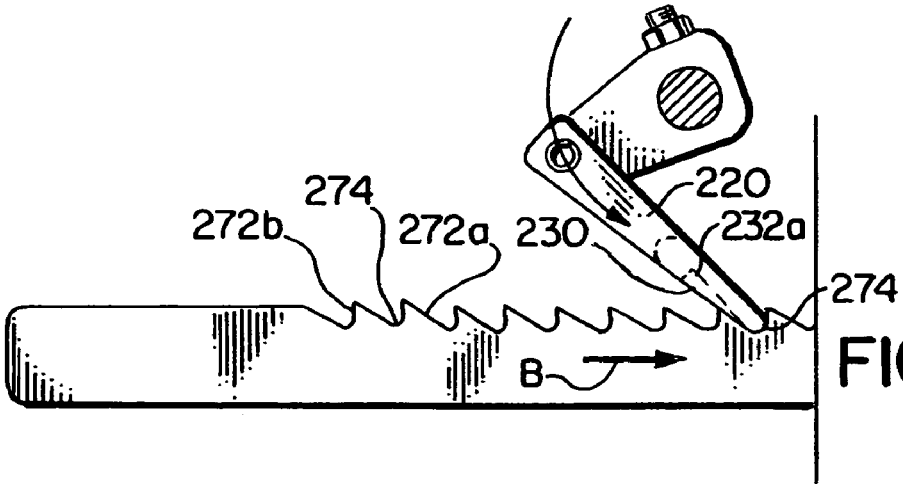

As best seen in FIG. 4, the bottom surface 228*d* of the single elongated structure 222 has an indented cavity 230 formed therein. The indented cavity 230 is dimensioned to receive the rear ratchet tooth 272*b*, as best seen in FIG. 7. The rear ratchet tooth 272*b* is rearward of the front ratchet tooth 272*a* the cam member 220 is currently applying pressure to as it rotates in ratchet channel 274.

Figure 3:
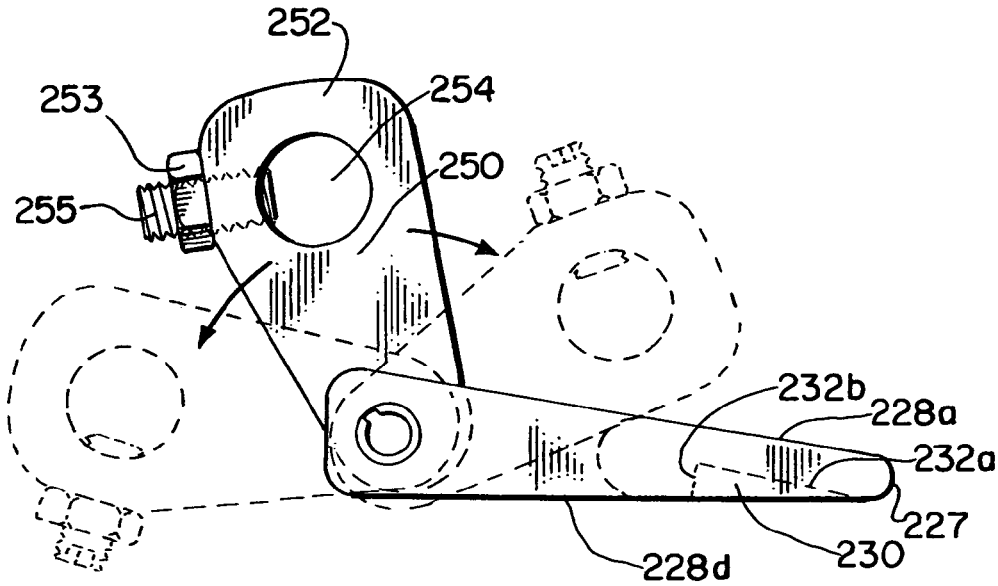
FIG. 3 is a side view of the cam member of the embodiment of FIG. 2 in an intermediate position with the first and second end positions shown in phantom.

The indented cavity 230 is a generally hollow triangularly-shaped formation, as shown in phantom in FIG. 3, created in the bottom surface 228*d* of the single elongated structure 222. Indented cavity 230 includes a slanted top surface 232*a*, an end wall 232*b* and first and second sidewalls 232*c* and 232*d*. The slanted top surface 232*a* essentially begins at the rounded underside of the front distal end 227 and gradually tracks upward at an incline. The slanted top surface 232*a* of the indented cavity 230 forms an acute angle with end wall 232*b*.

Referring again to FIG. 7, the degree of incline of the slanted top surface 232*a* of the indented cavity 230 generally tracks the incline of the rear ratchet tooth 272*b*. Thus, when the cam member 220 has completed one full arc-of-rotation in the ratchet channel 274, the rear ratchet tooth 272*b* is recessed in the indented cavity 230.

In view of the foregoing description, the unitary design of the cam member 220 allows it to be manufactured using injection molding with stainless steel or other structurally strong materials or metals. The injection molding manufacturing time to create the cam member 220 is significantly less labor intensive while creating a more precisely designed structure. Furthermore, the cam assembly 210, as described, has an improved wear factor such that the enlarged surface area and thickness of the second end 226 which is in direct metal-to-metal contact when pushing and rotating in the ratchet channel 274 is increased from that of the pin in the prior art of FIG. 1. Thus, the time between replacements of the cam member 220 or cam assembly 210 is greatly reduced. In other words, the useful life of the cam member 210 and thus the cam assembly 200 is increased.

Additionally, from the foregoing description, the cam assembly 210 has a cam member 220 that is designed to have an improved tooth-to-ratchet channel fit to increase the arc-of-rotation of the cam member 210 in the ratchet channel 274.

FIG. 3 illustrates different positions of the cam member 210 with respect to the movement of cam connector 250. In one position (shown in phantom), the cam connector 250' is shown at an acute angle with respect to the cam member 210. In a second position, the cam connector 250 is shown at an obtuse angle with respect to the cam member 210. In a third position (shown in phantom), the cam connector 250" is shown approximately aligned 180 degrees with respect to the cam member 210.

Figure 2:
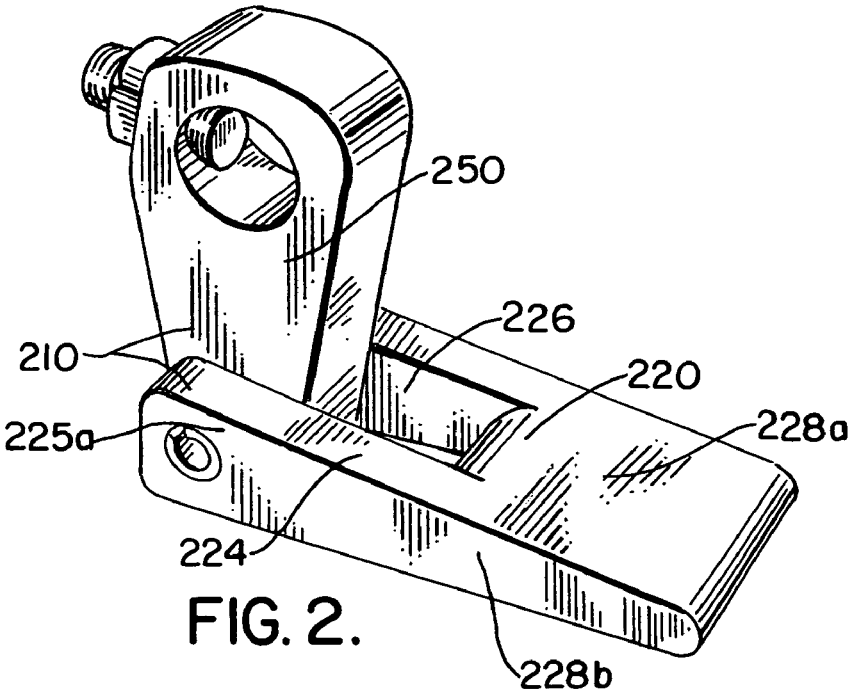
FIG. 2 is a perspective view of a top side of the cam member and cam connector in accordance with the present invention.

The cam connector 250 has a quasi-tear drop shape. The quasi-tear drop shape includes a first wider portion 252 having formed therein a through hole 254. The through hole 254 is adapted to receive therethrough the handle bar member 320. The handle bar member 320 is secured in the through hole 254 via washer 253 and securing bolt 255. The securing bolt 255 penetrates the through hole 254 at a location that is substantially 90 degrees offset from the center axis of such hole, as best seen in FIGS. 2 and 3.

The quasi-tear drop shape further includes a second narrower portion 256 having formed therein a through hole 257 adapted to receive the pin member 236 for pivotally coupling the cam member 210 to the cam connector 250.

As can be appreciated, the cam connector 250 has less material than the L-shaped connector of the prior art.

While not wishing to be bound by theory, I believe that the quasi-tear drop profile of the cam connector 250 that significantly rounds the corners thereofin combination with the both design of the cam assembly 210 and the existing flanges recessing plate 306 allows for an increase over competitive commercially available machines in the distance traveled by the pusher arm 270 during a full arc-of-rotation of the cam member 220 in the ratchet channel 274. The combination of the recessed plate 306 with the quasi-tear drop design provides a sufficient clearance to increasing the arc-of-rotation of the cam connector 250 as handle 320 is rotated.

Referring now to FIG. 5, the icemaker 300 will be described briefly. The pusher arm 270 is attached to one face of plate 308 (shown in phantom) and extends to the exterior of the icemaker 300 through slot 304 in the inner plate 306.

Figure 6:
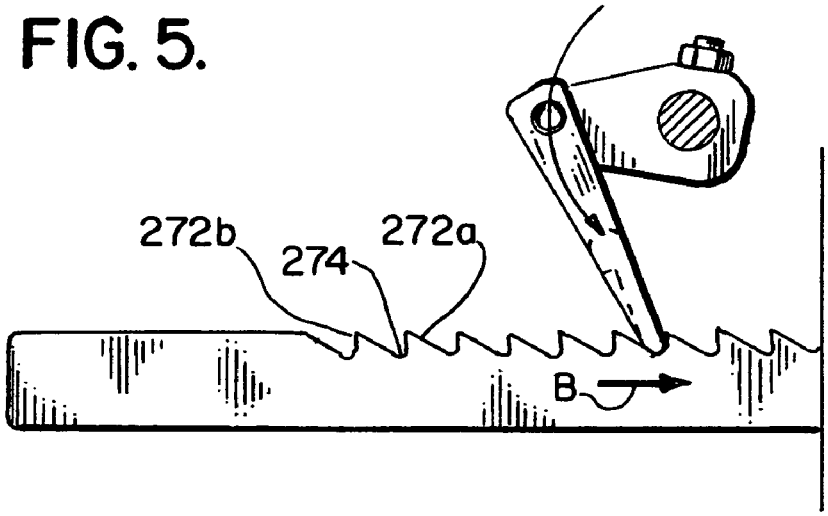
FIG. 6 is a side view of the cam assembly in accordance with the present invention with the cam member in a first position within a ratchet channel; and, FIG. 7 is a side view of the cam assembly in accordance with the present invention with the cam member in a full stroke position within a ratchet channel.

Referring now to FIGS. 3 and 6–7, in operation, the front distal end 227 is set in a respective one ratchet channel 274 farthest from plate 306 such that is the orientation of cam connector 250 with respect to cam member 220 is in general the third position shown in FIG. 3 adjusted to the location of the handle 320. Thus, the full arc-of-rotation begins when the front distal end 227 engages the inclined surface of the rear ratchet tooth 272*b* and ends when the rear ratchet tooth 272*b* is received in cavity 230 such that the inclined surface of the rear ratchet tooth 272*b* is in direct surface-to-surface contact with surface 232*a* of cavity 230.

The front distal end 227 is advanced towards plate 306 by application of torque to handle 320. As the handle 320 is rotated, the cam connector 250 is rotated in the same direction. As the front distal end 227 advances, the cam member 210 pivots about pin member 236 connected to cam connector 250.

Once the pusher arm 270 has been advanced, in the direction of ARROW B, as far as possible by engagement with one of the ratchet teeth 272*a* such as after the completion of a full arc-of-rotation, pressure is released on the handle 320 and the front distal end 227 is engaged with a ratchet tooth closer to the end of pusher arm 270 (such end of the pusher arm 270 being in a direction opposite that of ARROW B.) Torque applied to the handle 320 can then be applied to once again advance the pusher arm 270 and, thus, the pusher plate 308.

The operation is described with respect to a full arc-of-rotation of the cam member 210. As can be appreciated, an amount of ice shavings can be created without the need for a full arc-of-rotation. However, during operation, depending on the size of the snowball at least one full arc-of-rotation may be needed. The full arc-of-rotation when traveled provides a increase in the distance the pusher plate 308 can apply pressure to the block of ice as it is being shaved. Thus, a larger volume of shaving are created per full arc-of-rotation.

It is noted that the embodiment of the cam assembly described herein in detail, for exemplary purposes, are of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A cam assembly for an icemaker having a pusher arm with ratchet teeth comprising:

a cam connector, the cam connector is adapted to be coupled to a handle of said icemaker; and, a cam member having a single elongated structure that has a gradually tapering width from back to front, the back having a forked end pivotally coupled to said cam connector and the front having a second end, the second end has formed in a bottom surface thereof, a indented cavity for receipt of a ratchet tooth.

2. The assembly of claim 1, wherein:

said forked end comprises first and second essentially parallel fork members each of which has a through hole formed therein; and, further comprising a pin member journalled through the through holes.

3. The assembly of claim 1, wherein:

the cam connector has a quasi-tear drop shape.

4. The assembly of claim 1, wherein the cam connector comprises a quasi-tear drop shape, said shape comprises:

a first wider portion having formed therein a first through hole adapted to receive therethrough said handle;

a second narrower portion having formed therein a second through hole adapted to receive a pin member for pivotally coupling the cam member to the cam connector.

5. The assembly of claim 4, further comprising:

a washer; and, a securing bolt, the securing bolt penetrates the first through hole at a location that is substantially 90 degrees offset from a center axis of said first through hole.

6. The assembly of claim 1, wherein said indented cavity is substantially a hollow triangularly-shaped formation created in a bottom surface of said single elongated structure.

7. The assembly of claim 6, wherein:

the second end has a rounded front distal end; and, the indented cavity comprises:

a slanted top surface, the slanted top surface essentially begins at a rounded underside of the front distal end and gradually tracks upward at an incline, an end wall wherein said slanted top surface forms an acute angle with said end wall, and first and second sidewalls.

8. The assembly of claim 7, wherein:

a degree of incline of said slanted top surface of said indented cavity substantially tracks an incline of said ratchet tooth.

9. The assembly of claim 6, wherein:

when the cam member completes one full arc-of-rotation in a ratchet channel between two adjacent ratchet teeth, a rear ratchet tooth of said two adjacent ratchet teeth is recessed in said indented cavity.

10. The assembly of claim 1, wherein:

when the cam member completes one full arc-of-rotation in a ratchet channel between two adjacent ratchet teeth, a rear ratchet tooth of said two adjacent ratchet teeth is recessed in said indented cavity.

11. An icemaker comprising:

means for shaving ice;

a pusher arm with ratchet teeth;

a handle; and, a cam assembly, the cam assembly comprising:

a cam connector, the cam connector is adapted to be coupled to said handle of said icemaker and a cam member having a single elongated structure that has a gradually tapering width from back to front, the back having a forked end pivotally coupled to said cam connector and the front having a second end, the second end has formed in a bottom surface thereof, a indented cavity for receipt of a ratchet tooth.

12. The icemaker of claim 11, wherein:

said forked end comprises first and second essentially parallel fork members each of which has a through hole formed therein; and, further comprising a pin member journalled through the through holes.

13. The icemaker of claim 11, wherein:

the cam connector has a quasi-tear drop shape.

14. The icemaker of claim 11, wherein the cam connector comprises a quasi-tear drop shape, said shape comprises:

a first wider portion having formed therein a first through hole adapted to receive therethrough said handle;

a second narrower portion having formed therein a second through hole adapted to receive a pin member for pivotally coupling the cam member to the cam connector.

15. The icemaker of claim 14, further comprising:

a washer; and, a securing bolt, the securing bolt penetrates the first through hole at a location that is substantially 90 degrees offset from a center axis of said first through hole.

16. The icemaker of claim 11, wherein said indented cavity is substantially a hollow triangularly-shaped formation created in a bottom surface of said single elongated structure.

17. The icemaker of claim 16, wherein:

the second end has a rounded front distal end; and, the indented cavity comprises:

a slanted top surface, the slanted top surface essentially begins at a rounded underside of the front distal end and gradually tracks upward at an incline, an end wall and first and second sidewalls wherein said slanted top surface forms an acute angle with said end wall.

18. The icemaker of claim 17, wherein:

a degree of incline of said slanted top surface of said indented cavity substantially tracks an incline of said ratchet tooth.

19. The icemaker of claim 16, wherein:

when the cam member completes one full arc-of-rotation in a ratchet channel between two adjacent ratchet teeth, a rear ratchet tooth of said two adjacent ratchet teeth is recessed in said indented cavity.

20. The icemaker of claim 11, wherein:

when the cam member completes one full arc-of-rotation in a ratchet channel between two adjacent ratchet teeth, a rear ratchet tooth of said two adjacent ratchet teeth is recessed in said indented cavity.

* * * * *